United States Patent [19]

Sebastian et al.

[11] Patent Number: 4,864,666

[45] Date of Patent: Sep. 12, 1989

[54] FLUID-ISOLATION BATHING APPARATUS

[76] Inventors: Carlos F. Sebastian, 5805 Denny Ave., North Hollywood, Calif. 91601; Gerald H. Vind, 550 S. Barrington, #2233, Los Angeles, Calif. 90049

[21] Appl. No.: 130,120

[22] PCT Filed: Mar. 23, 1987

[86] PCT No.: PCT/US87/00599

§ 371 Date: Sep. 28, 1987

§ 102(e) Date: Sep. 28, 1987

[87] PCT Pub. No.: WO88/07346

PCT Pub. Date: Oct. 6, 1988

[51] Int. Cl.[4] ..... E04H 3/18

[52] U.S. Cl. ..... 4/495; 4/580; 128/65

[58] Field of Search ..... 4/495, 580; 128/65, 128/365, 369

[56] References Cited

U.S. PATENT DOCUMENTS 3,670,343 6/1972 Gansloser ..... 4/495

3,760,432 9/1973 Glorisi ..... 4/495

4,648,392 3/1987 Cartier et al. ..... 128/65 X

FOREIGN PATENT DOCUMENTS 2642823 3/1978 Fed. Rep. of Germany ..... 4/580

3046628 7/1982 Fed. Rep. of Germany ..... 4/559

*Primary Examiner*—Charles E. Phillips

[57] ABSTRACT

An apparatus that permits fluid-isolation bathing whereby a bather can bathe in a relatively small volume of bathing fluid or liquid selected for special properties (e.g. cleansing or soaking). The bather is isolated from a larger surrounding volume of water by means of a thin-walled bag. The bather enters and exits the apparatus by means of a hydraulically actuated piston-like platform that is fitted to a cylindrical bathing container filled with water. The hydraulic circulation of the water between top and bottom of the container is accomplished by a bather-controlled pump and valve mechanism. The invention provides sanitary bathing through the fluid-isolation of disposable thin-walled bathing bags. It also permits bathing the entire body surface in a small volume of bathing fluids that may be realatively costly.

10 Claims, 2 Drawing Sheets

FLUID-ISOLATION BATHING APPARATUS

TECHNICAL FIELD

This invention pertains to private and commercial bathing. It is a bathing apparatus employing a bathing bag containing a small amount of bathing fluid that is pressed against the bather inside the bag by surrounding water in the apparatus. Thus, it provides sanitary protection from previous bathers by means of a replacable bathing bag, isolating the bather from the surrounding volume of water.

BACKGROUND ART

There is no known device or apparatus sold commercially that is similar to the the bathing apparatus described herein. There is no known United States patent granted that resembles the subject invention. There are special applications of fluid containment bags in the administration of medical fluids by physicans to the skin of burn victims, however, these are not similar to the subject invention. Medical use of bags for fluid containment in various treatment modalities is different from the subject invention in two ways: (1) Application is na integral part of a medical protacol and is usually administered while the subject is in a bed, thus there is no fluid surrounding the outside of the bag to exert pressure on the bag and its contents; (2) There is no connection between the medical use of bags and any patient handling apparatus similar to the subject invention.

Historically, and presently, persons wishing to bathe inside of a bag in a manner that provids fluid pressure from external water on the contents of the bag have been limited to ordinary pools or containers having a suitable depth. These bathers must then use a flotation coller or mechanical device to support the top of the bag. Flotation rings are known to be used in bag-bathing in some European spas. Such applications, however, do not employ an apparatus to protect the bather and bathing fluid from possible microbiological or chemical contamination in waters of the surrounding pool or container. Such applications also do not provide bathers an actuated hydraulic apparatus for immersing and removing the bather and bathing bag from the surrounding waters of a pool or bathing container.

SUMMARY OF THE INVENTION

A bathing apparatus that includes a cylindrical-rigid bathing container that is filled with water and fitted with a piston-like platform on which the bather stands. The platform moves up or down hydraulic action of water, when the water is circulated in the bathing container through inlets and outlets at the top and bottom of said container. The bather stands on the platform inside of a thin-walled bathing bag. When the platform is in its top position the bather places a bathing bag in the center of the platform, steps upon it, and fastens the top of the bag to the top of the bathing container. The bather actuates a control device and the platform is lowered. Prior to or during platform lowering, a bathing liquid is poured into the bathing bag. As the platform lowers to the cylinder bottom, the water flows into the top of the cylinder and above the platform, thereby pressing the bathing liquid against the bather. On completion of bathing, the bather (or an attendant) actuates controls that reverse the flow of water in the cylinder causing platform, bather, and bathing bag enclosing the bathing liquid to return to the top. The invention permits fluid-isolation bathing, whereby any bather can bathe in a relatively small volume of a bathing liquid that is isolated by means of a thin-walled bathing bag from the larger volume of water in the bathing container. The bendifts of this invention are: (1) Economies of bathing in costly bathing liquids through the containment of the bathing bag; (2) Sanitary bathing through isolation by disposable thin-walled bathing bags.

Figure 1:
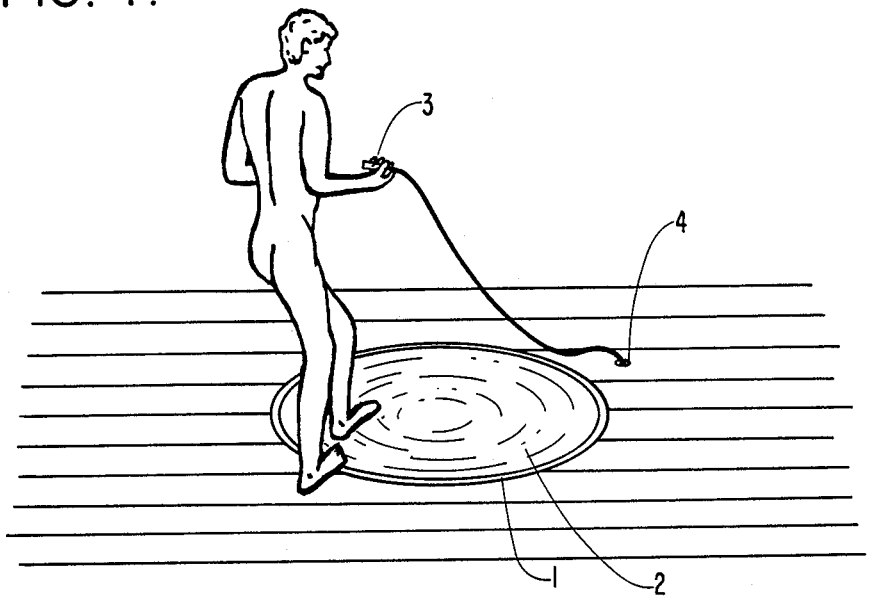
FIG. 1 is an illustration of the invention installed with its top flush with the floor level. The bather is illustrated stepping onto the top of the piston-like platform that is covered with a thin-walled bathing bag fitted to the top of the bathing container. Numeral 1 identifies the locking ring that holds the top of the bathing bag securely to the outside diameter of the top of the water-filled bathing container. Numeral 2 identifies the thin walled bathing bag with the top held in place by the locking ring, and the slack portion on the bathing platform. Numeral 3 identifies a hand-held control that operates the bathing apparatus, although a remote control may be operated by an attendant. Numeral 4 identifies a jack connecting the hand-held control to the actuating mechanism of the apparatus.
Figure 2:
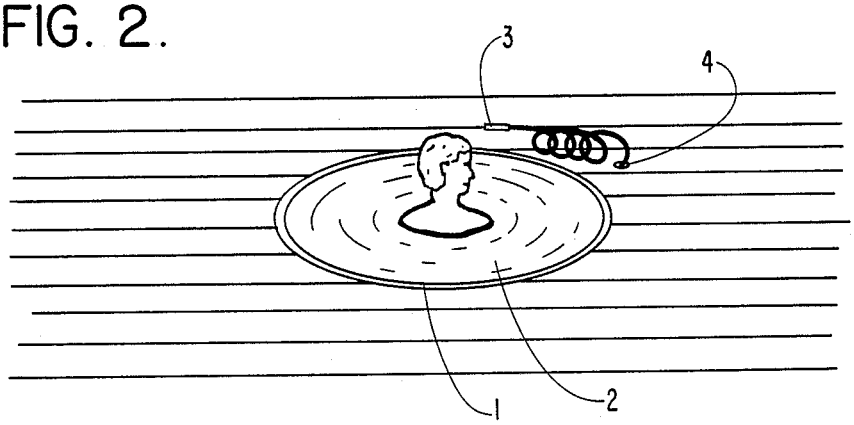
FIG. 2 is an illustration of the apparatus with the bather lowered into the water-filled bathing container, yet isolated from water in the container by the thin-walled bathing bag.
Figure 3:
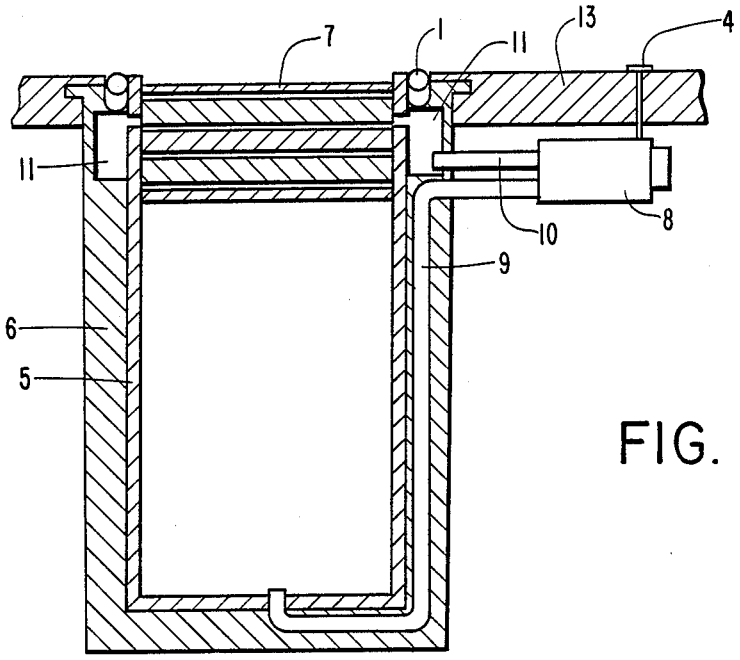
FIG. 3 is an illustration, in cross section, of the invention with the piston-like platform raised to the top.
Figure 4:
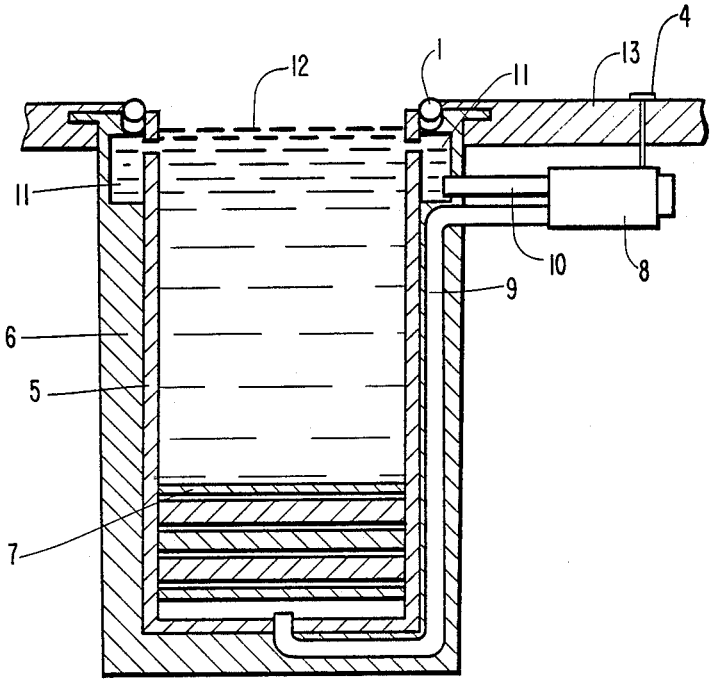
FIG. 4 is an illustration, in cross section, of the invention with the piston-like platform lowered to the bottom. Numeral 4 identifies the jack that connects the hand-held controls to the actuating mechanism of the apparatus. Numeral 5 identifies the bathing container which is a rigid-right cylinder that is closed at the bottom and water tight when filled with water. Numeral 6 identifies the structure that supports the bathing container and the contents of said bathing container. Numeral 7 identifies the bathing platform which is a piston-like cylinder closed on the top and bottom and fitted to the walls of the bathing container in a manner to permit movement up or down through the hydraulic action of water in the apparatus. Numeral 8 identifies a pump and valve mechanism that is the actuating mechanism of the invention, which provides the means to alternately circulate water in the bathing container from bottom to top (lowering the bathing platform) and from top to bottom (raising the bathing platform). Numeral 9 identifies the pipe connecting the pump and valve mechanism with the opening in the bathing container bottom. Numeral 10 identifies the pipe connecting the pump and valve mechanism to the overflow chamber that encircles the top of the bathing container. Numeral 11 identifies the overflow chamber that encircles the top of the bathing container and provides several openings into said container through which the water circulates into and out of the top of the bathing container. Numeral 12 identifies the surface of the water filling the bathing container. Numeral 13 identifies the floor or decking that supports the apparatus.

In operation, the invention is recessed in a floor or fitted with decking to provide a platform on which bathers stand to enter and exit the apparatus. The bather (or an attendant) fits a thin-walled bathing bag to a lip around the top of the bathing container. A mechanical locking device holds the top of the bag in place. The bather steps onto the platform and into the center of the bag. A small amount of a special bathing fluid (e.g., four to eight liters) is poured into the bag; the lip holding the top of the bag is of sufficient height (e.g., four centimeters) to contain bathing fluid when said platform is fully raised. Alternately, the container lip may be recessed to floor or deck level, in which case it would be necessary to lower the said platform four centimeters before fitting the bag and pouring in the bathing fluid. The apparatus may be constructed in any size to accept one or two bathers. The typical size would provide comfortable bathing container side-wall and depth clearance for a large bather.

The pump and valve mechanism, which provides for alternating the directional flow of water to raise and lower the bathing platform, may be implemented in several configurations; it may also be implemented with only a reversable pump and thus eliminate some or all of the valve mechanism.

We claim:

1. A fluid-isolation bathing apparatus comprising:

(a) a rigid container having an open top, with a closed bottom and a closed peripheral wall extending therebetween, (b) a platform movable up and down within said container, (c) a thin-walled bathing bag shaped similiarly to said container and being positioned within said container, with said bag having a top periphery secured around said open top of said container and with the closed bottom and peripheral wall of said bag extending within said container, (d) a means to introduce water into said container, and to receive any overflow thereof when said bathing bag is occupied for bathing, (e) a hydraulic means to circulate water within said container to produce hydraulic actuation to raise and lower said platform, and simultaneously use said water for the immersion of the bathing bag and bather, (f) a pump and valve mechanism to control the direction and flow-rate of said water circulating within said container, (g) wherein, with said platform in an up position the user steps onto said platform and into said bag, a bathing liquid is introduced into said bag and the platform is lowered, whereby water surrounds said bag to cause said bag to closely surround said user and said bathing liquid.

2. The bathing apparatus of claim 1, in which;

(a) said bathing liquid is of the class of fluids that soak and cleanse.

3. The bathing apparatus of claim 1 in which;

(a) said bathing liquid is of the class of fluids with therapeutic properties.

4. The bathing apparatus of claim 1 in which;

(a) the volume of said bathing liquid is a fraction of the volume of water in the bathing container.

5. The bathing apparatus of claim 4 in which;

(a) said fraction is a small fraction.

6. The bathing apparatus of claim 1 in which;

(a) said platform is substantially coextensive with the inner extent of said container, and (b) said platform is coextensive with said container in such manner as to provide a seal against leakage of said water between said platform and said container peripheral wall when hydraulic action moves said platform up or down.

7. The bathing apparatus of claim 1 in which;

(a) said rigid bathing container is a right cylinder.

8. The bathing apparatus of claim 1 in which;

(a) said hydraulic means is a hydraulic pump and valve mechanism, having, (1) an opening that is alternately an inlet and outlet, and is connected hydraulically to the bottom of said container, and (2) an opening that is alternately an outlet and inlet, that is connected hydraulically to the top of said container.

9. The bathing apparatus of claim 8 in which;

(a) control means for actuating said hydraulic pump and valve mechanism for circulation of said water for the purpose of moving said platform, and (b) said control means disposed for handling by the person utilizing said bathing apparatus while said person is bathing.

10. The bathing apparatus of claim 9 in which siad control means includes;

(a) a switch for effecting actuation of said pump and valve mechanism, and (b) a flexible extension for said switch that is operated by a bather and connected to said pump and valve mechanism.

* * * * *